United States Patent [19]

Garwood et al.

[11] 3,960,705

[45] June 1, 1976

[54] CONVERSION OF FOOTS OIL TO LUBE BASE STOCKS

[75] Inventors: William E. Garwood, Haddonfield, N.J.; John J. Wise, Media, Pa.

[73] Assignee: Mobil Oil Corporation, New York, N.Y.

[22] Filed: June 17, 1975

[21] Appl. No.: 587,760

Related U.S. Application Data

[63] Continuation-in-part of Ser. No. 453,246, March 21, 1974, Pat. No. 3,893,906, and a continuation-in-part of Ser. No. 391,380, Aug. 24, 1973, Pat. No. 3,894,939.

[52] U.S. Cl. ..... 208/111; 208/18; 208/28; 208/30; 208/137; 208/141; 208/144; 252/455 Z

[51] Int. Cl.[2] ..... C10G 13/02; C10G 41/00; C10L 1/04

[58] Field of Search ..... 208/111

[56] References Cited

UNITED STATES PATENTS

| | | | |
|---|---|---|---|
| 3,046,218 | 7/1962 | Henke et al. | 208/109 |
| 3,597,473 | 8/1971 | Frilette et al. | 260/666 |
| 3,700,585 | 10/1972 | Chen et al. | 208/111 |
| 3,702,886 | 11/1972 | Argauer et al. | 423/328 |
| 3,729,409 | 4/1973 | Chen | 208/135 |
| 3,753,891 | 8/1973 | Graven et al. | 208/62 |
| 3,758,402 | 9/1973 | Oleck et al. | 208/111 |
| 3,767,568 | 10/1973 | Chen | 208/134 |
| 3,804,746 | 4/1974 | Chu | 208/111 |
| 3,830,723 | 8/1974 | Ladeur et al. | 208/108 |

*Primary Examiner*—Delbert E. Gantz
*Assistant Examiner*—G. E. Schmitkons
*Attorney, Agent, or Firm*—Charles A. Huggett; Michael G. Gilman

[57] ABSTRACT

Foots oil, the by-product left when high quality wax is recovered by a solvent dewaxing process, is usually used as cracker feed stock. There is disclosed a method of converting it to higher quality lubricant base stock by subjecting such to catalytic hydroprocessing utilizing a ZSM-5 or similarly behaving zeolite catalyst under hydrogen pressure followed by distillation of the product to remove light products such as naphtha, LPG and No. 2 fuel oil therefrom.

2 Claims, No Drawings

CONVERSION OF FOOTS OIL TO LUBE BASE STOCKS

This application is a Continuation-in-part of Application Ser. No. 453,246, filed Mar. 21, 1974, and of Application Ser. No. 391,380, filed Aug. 24, 1973, now U.S. Pat. Nos. 3,893,906, and 3,894,939, respectively.

This invention relates to upgrading of petroleum fractions. It more particularly refers to the conversion of relatively low value by-product to a relatively high value lubricant base stock.

Lubricant base stocks are generally in relatively short supply since only certain kinds of crudes contain fractions which are suitable for this use. Lubricant base stocks-containing crudes therefore have a relatively high value. It is conventional to treat such crudes by subjecting such to atmospheric distillation followed by vacuum distillation from which the lube base stock boiling range cut is taken, solvent extracted, usually with furfural, and then solvent dewaxed, usually with methylethyl ketone or the like to produce a product which, upon filtration, is separated into a lubricant base stock and a wax. In order to further purify the wax fraction into a product of extremely high value, it is subjected to conventional deoiling from which a rather hard waxy product is recovered and from which a mixture of oil and soft wax by-product is also produced. This mixture of oil and soft wax is generally referred to as Foots oils.

Various grades of lubricant base stocks are suitable for dewaxing according to the above described conventional process to produce this hard, high value wax product. Light neutral, heavy neutral and bright stock are typical examples of such base stocks. The distillate fraction utilized for these properties often has a boiling range of 650°F+.

It is conventional to recycle the Foots oil produced in this wax recovering process to a catalytic cracker of one sort or another, if such exists in the refinery in question, or, if possible, to sell the Foots oil as cracker feed stock to another refinery. Another alternative is to degrade the Foots oil into a heavy fuel oil fraction. This is probably the poorest of the alternatives from a monetary return point of view.

There has recently been developed a process referred to as catalytic hydrodewaxing in which the gas oil is contacted with hydrogen and a shape selective catalyst adapted to selectively crack or hydrocrack the paraffinic molecules in the gas oil. Initially the catalysts used were those zeolite cracking catalysts which had pore openings sized so that they would admit and crack only normal paraffins and exclude all other gas oil components e.g. erionite type zeolite. Later this process was improved through substituting ZSM-5 type of zeolite for the previously used erionite type cracking catalyst. (See U.S. Pat. No. 3,700,585). Using this type catalyst permitted more efficient operation. In addition to the normal paraffins, paraffins with slight branching e.g. with a methyl side group, were also cracked whereby dewaxing was carried out to a greater extent. This permitted lowering of the gas oil pour point in a very efficient manner. The product of hydrodewaxing gas oil is suitably fractioned to produce high yields of dewaxed gas oil boiling in the same range as the feed, some naphtha and some light ($C_4^-$) ends.

In addition to the ZSM-5 type zeolites, other special zeolites are useful in this dewaxing process.

The special zeolite catalysts referred to herein utilize members of a special class of zeolites exhibiting some unusual properties. These zeolites induce profound transformations of aliphatic hydrocarbons to aromatic hydrocarbons in commercially desirable yields and are generally highly effective in alkylation, isomerization, disproportionation and other reactions involving aromatic hydrocarbons. Although they have unusually low alumina contents, i.e. high silica to alumina ratios, they are very active even with silica to alumina ratios exceeding 30. This activity is surprising since catalytic activity of zeolites is generally attributed to framework aluminum atoms and cations associated with these aluminum atoms. These zeolites retain their crystallinity for long periods in spite of the presence of steam even at high temperatures which induce irreversible collapse of the crystal framework of other zeolites, e.g. of the X and A type. Furthermore, carbonaceous deposits, when formed, may be removed by burning at higher than usual temperatures to restore activity. In many environments, the zeolites of this class exhibit very low coke forming capability, conducive to very long times on stream between burning regenerations.

An important characteristic of the crystal structure of this class of zeolites is that it provides constrained access to, and egress from, the intra-crystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred zeolites useful as catalysts in this invention possess, in combination: a silica to alumina ratio of at least about 12; and a structure providing constrained access to the cyrstalline free space.

The silica to alumina ratio referred to may be determined by conventional analysis. This ratio is meant to represent, as closely as possible, the ratio in the rigid anionic framework of the zeolite crystal and to exclude aluminum in the binder or in cationic or other form within the channels. Although zeolites with a silica to alumina ratio of at least 12 are useful, it is preferred to use zeolites having higher ratios of at least about 30. Such zeolites, after activation, acquire an intracrystalline sorption capacity for normal hexane which is greater than that for water, i.e. they exhibit "hydrophobic" properties. It is believed that this hydrophobic character is advantageous in the present invention.

The zeolites useful as catalysts in this invention freely sorb normal hexane and have a pore dimension greater than about 5 Angstroms. In addition, their structure must provide constrained access to some larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is substantially excluded and the zeolite is not of the desired type. Zeolites with windows of 10-membered rings are preferred, although excessive puckering or pore blockage may render these zeolites substantially ineffective. Zeolites with windows of twelve-membered rings do not generally appear to offer sufficient constraint to produce the advantageous conversions desired in the instant invention, although structures can be conceived, due to pore blockage or other cause, that may be operative.

Rather than attempt to judge from crystal structure whether or not a zeolite possesses the necessary constrained access, a simple determination of the "constraint index" may be made by continuously passing a mixture of equal weight of normal hexane and 3-methylpentane over a small sample, approximately 1 gram or less, of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000°F for at least 15 minutes. The zeolite is then flushed with helium and the temperature adjusted between 550°F and 950°F to give an overall conversion between 10% and 60%. The mixture of hydrocarbons is passed at 1 liquid hourly space velocity (i.e., 1 volume of liquid hydrocarbon per volume of catalyst per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "constraint index" is calculated as follows:

$$\text{Constraint Index} = \frac{\log_{10}(\text{fraction of n-hexane remaining})}{\log_{10}(\text{fraction of 3-methylpentane remaining})}$$

The constraint index approximates the ratio of the cracking rate constants for the two hydrocarbons. Catalysts suitable for the present invention are those which employ a zeolite having a constraint index from 1.0 to 12.0. Constraint Index (CI) values for some typical zeolites including some not within the scope of this invention are:

| CAS | C.I. |
|---|---|
| ZSM-5 | 8.3 |
| ZSM-11 | 8.7 |
| ZSM-35 | 4.5 |
| TMA Offretite | 3.7 |
| ZSM-12 | 2 |
| ZSM-38 | 2 |
| Beta | 0.6 |
| ZSM-4 | 0.5 |
| Acid Mordenite | 0.5 |
| REY | 0.4 |
| Amorphous Silica-alumina | 0.6 |
| Erionite | 38 |

The above-described Constraint Index is an important and even critical, definition of those zeolites which are useful to catalyst the instant process. The very nature of this parameter and the recited technique by which it is determined, however, admit of the possibility that a given zeolite can be tested under somewhat different conditions and thereby have different constraint indexes. Constraint Index seems to vary somewhat with severity of operation (conversion). Therefore, it will be appreciated that it may be possible to so select test conditions to establish multiple constraint indexes for a particular given zeolite which may be both inside and outside the above defined range of 1 to 12.

Thus, it should be understood that the "Constraint Index" value as used herein is an inclusvie rather than an exclusive value. That is, a zeolite when tested by any combination of conditions within the testing definition set forth herein above to have a constraint index of 1 to 12 is intended to be included in the instant catalyst definition regardless that the same identical zeolite tested under other defined conditions may give a constraint index value outside of 1 to 12.

The class of zeolites defined herein is exemplified by ZSM-5, ZSM-11, ZSM-12, ZSM-21, ZSM-35, ZSM-38 and other similar material. Recently issued U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

U.S. Pat. application, Ser. No. 358,192, filed May 7, 1973, the entire contents of which are incorporated herein by reference, describes a zeolite composition, and a method of making such, designated as ZSM-21 which is useful in this invention.

U.S. Pat. application Ser. No. 528,061 filed Nov. 29, 1974, the entire contents of which are incorporated herein by reference, describes a zeolite composition including a method of making it. This composition is designated ZSM-35 and is useful in this invention.

U.S. Pat. application Ser. No. 528,060, filed Nov. 29, 1974, the entire contents of which are incorporated herein by reference, describes a zeolite composition including a method of making it. This composition is designated ZSM-38 and is useful in this invention.

The x-ray diffraction pattern of ZSM-21 appears to be generic to that of ZSM-35 and ZSM-38. Either or all of these zeolites is considered to be within the scope of this invention.

The specific zeolites described, when prepared in the presence of organic cations, are substantially catalytically inactive, possibly because the intracrystalline free space is occupied by organic cations from the forming solution. They may be activated by heating in an inert atmosphere at 1000°F. for one hour, for example, followed by base exchange with ammonium salts followed by calcination at 1000°F. in air. The presence of organic cations in the forming solution may not be absolutely essential to the formation of this special type zeolite; however, the presence of these cations does appear to favor the formation of this special type of zeolite. More generally, it is desirable to activate this type zeolite by base exchange with ammonium salts followed by calcination in air at about 1000°F. for from about 15 minutes to about 24 hours.

Natural zeolites may sometimes be converted to this type zeolite by various activation procedures and other treatments such as base exchange, steaming, alumina extraction and calcination, alone or in combinations. Natural minerals which may be so treated include ferrierite, brewsterite, stilbite, dachiardite, epistilbite, heulandite and clinoptilolite. The preferred crystalline aluminosilicates are ZSM-5, ZSM-11, ZSM-12 and ZSM-21, with ZSM-5 particularly preferred.

The zeolites used as catalysts in this invention may be in the hydrogen form or they may be base exchanged or impregnated to contain ammonium or a metal cation complement. It is desirable to calcine the zeolite after base exchange. The metal cations that may be present include any of the cations of the metals of Groups I through VIII of the periodic table. However, in the case of Group IA metals, the cation content should in no case be so large as to substantially eliminate the activity of the zeolite for the catalysis being employed in the instant invention. For example, a completely sodium exchanged H-ZSM-5 appears to be largely inactive for shape selective conversions required in the present invention.

In a preferred aspect of this invention, the zeolites useful as catalysts herein are selected as those having a crystal framework density, in the dry hydrogen form, of not substantially below about 1.6 grams per cubic centimeter. It has been found that zeolites which satisfy all three of these criteria are most desired. Therefore, the preferred catalysts of this invention are those comprising zeolites having a constraint index as defined above of about 1 to 12, a silica to alumina ratio of at least about 12 and a dried crystal density of not substantially less than about 1.6 grams per cubic centimeter. The dry density for known structures may be calculated from the number of silicon plus aluminum atoms per 1000 cubic Angstroms, as given, e.g., on page 19 of the article on Zeolite Structure by W. M. Meier. This paper, the entire contents of which are incorporated herein by reference, is included in "Proceedings of the Conference on Molecular Sieves, London, Apr., 1967" published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density of course must be associated with a relatively small amount of free space within the crystal, which might be expected to result in more stable structures. This free space, however, seems to be important as the locus of catalytic activity.

Crystal framework densities of some typical zeolites including some which are not within the purview of this invention are:

| Zeolite | Void Volume | Framework Density |
|---|---|---|
| Ferrierite | 0.28 cc/cc | 1.76 g/cc |
| Mordenite | .28 | 1.7 |
| ZSM-5, -11 | .29 | 1.79 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

It is an object of this invention to provide a novel process for upgrading Foots oil to a more valuable product, particularly for upgrading Foots oil by catalytic hydrodewaxing to a lubricant base stock.

Other and additional objects of this invention will be apparent from a consideration of this entire specification including the claims hereof.

In accord with and fulfilling these objects, one aspect of this invention resides in the catalytic hydroprocessing of Foots oil having a boiling range within the range of 650° to 1,100°F and characterized as having a specific gravity at 70°C of about 0.800 to 0.8660 and a kinematic viscosity at 210°F of about 3.8 to about 24.0 cs. This conversion is accompished utilizing as the catalyst, a crystalline aluminosilicate zeolite having a high silica to alumina ratio of at least about 15, a constraint index of 1 to 12, a crystal density of not substantially below about 1.6 grams per cubic centimeter and containing a hydrogenation/dehydrogenation component in a proportion of up to about 10%. The instant process is carried out under hydrogen atmosphere at a pressure of about 250 to 750 psig, a temperature of about 500° to 800°F, a hydrogen circulation rate of about 500 to 2,500 SCF/B and a space velocity of about 0.5 to 20 LHSV. The product produced by this catalytic hydroprocessing is subject to conventional resolution, for example by distillation, into a fuel oil fraction, a light fraction, comprising LPG and naphtha, and a bottom fraction comprising a lubricant oil base stock which is substantially similar to the lubricant base stock originally produced by ketone solvent dewaxing of the original distillate used to produce the Foots oil of this process. In many instances, the lubricant base stock produced by this process can be directly blended with the lube oil base stock produced in the previous ketone dewaxing step and the blend employed in conventional lube oil processing applications.

Suitable hydrogenation/dehydrogenation components are metals conventionally known to operate in this manner and are exemplified by zinc, nickel, palladium, and other similar metals. This invention will be illustrated by the following examples which are not considered to be limiting on the scope thereof. Parts and percentages are by weight unless expressly stated to be on some other basis.

EXAMPLE 1

Foots oil having the following properties:

| | | |
|---|---|---|
| Specific Gravity at 70°C | | 0.8266 |
| Kinematic Viscosity at 210°F, cs | | 4.06 |
| Boiling range, °F. | approx. | 700–900 |

was mixed with 10% (based upon the total composition) benzene and the mixture treated at 750 psig, 750°F, 2 to 0.5 LHSV and 2000 SCF H/bbl for 11 days. The catalyst was ZSM-5 containing 0.47 wt. % zinc admixed with a 35% alumina binder. The product was composed of some light gas, a significant naphtha fraction, a fuel oil fraction boiling in the range of about 390° to 650°F+ lube oil fraction. The lube oil fraction averaged about 30 vol. % of the charge and had the following properties:

TABLE I

| | | |
|---|---|---|
| Gravity, °API | 26.7 | |
| Gravity, Specific | 0.8944 | |
| Pour Point, °F | −35 | |
| K.V. at 100°F, cs | 50.77 | |
| K.V. at 210°F, cs | 6.26 | |
| Viscosity Index | 70 | |
| Composition, Wt % | | |
| Paraffins | 15.2 | |
| Naphthenes | 52.4 | |
| 1-Ring | | 21.4 |

TABLE I-continued

| | | |
|---|---|---|
| 2-Ring | | 14.0 |
| 3-Ring | | 9.0 |
| 4,5,6-Ring | | 8.0 |
| Aromatics | 32.4 | |
| Alkybenzenes | | 7.7 |
| Tetralins, Indanes | | 8.7 |
| Naphthalenes | | 2.6 |
| Acenaphthenes, etc. | | 2.9 |
| Phenanthrenes, etc. | | 2.7 |
| Pyrenes | | 2.9 |
| Chrysenes | | 1.4 |
| Benzopyrenes, etc. | | 3.5 |
| Total | 100.0 | |

Foots oil from Arab Light crude having the following tabulated properties was subjected to catalytic hydroprocessing treatment using a NiZSM-5/$Al_2O_3$ catalyst under the conditions stated in the following Examples (see table 3 below).

TABLE 2

Properties of Foots Oil[1] from Deoiling Light Neutral Scale Wax

| Properties | |
|---|---|
| Gravity, API | 36.2 |
| Specific Gravity at 60°F | 0.8434 |
| Pour Point, °F | 90 |
| Flash Point, °F (COC) | 420 |
| KV at 210°F, cs | 3.87 |
| SUS at 210°F, sec. | 38.8 |
| Color, ASTM | LT 1.0 |
| Neutralization Number, Mg KOH/g | 0.12 |
| RCR, % wt | 0.07 |
| Sulfur, % wt | 0.334 |
| Nitrogen, % wt | 0.0019 |
| Refractive Index at 70°C | 1.44757 |
| Aniline Point, °F | 249.3 |
| Oil Content, % wt | 51.34 |
| Hydrogen, % wt | 14.16 |
| Distillation, | |
| IBP, % vol | 673 |
| 5 " | 726 |
| 10 " | 740 |
| 30 " | 756 |
| 50 " | 779 |
| 70 " | 812 |
| 90 " | 850 |
| 95 " | 865 |

TABLE 2—Continued

Properties of Foots Oil[1] from Deoiling Light Neutral Scale Wax

| | | |
|---|---|---|
| EP | " | — |

[1]Foots oil contained about 10% scale wax which bypassed deoiling.

Table 3

Product Yields from Catalytic Hydroprocessing Light Neutral Foots Oil

| 400 psig Total Pressure | | |
|---|---|---|
| Example No. | 2 | 3 |
| Hydroprocessing Conditions | | |
| Pressure, psig | 400 | 400 |
| Space Velocity, LHSV | 1.5 | 1.5 |
| $H_2$ Circulation, SCF/B[1] | 2600 | 2400 |
| Temperature, °F | 668 | 629 |
| $H_2$ Consumption, SCF/B | 100 | −125 |
| Desulfurization, % | 17.5 | 12.4 |
| Denitrogenation, % | 31.5 | 38.5 |
| 650°F+ Pour Point, °F | 25 | 35 |
| Product Yields, % of Charge | wt. | wt. |
| $H_2S$ | 0.1 | 0.04 |
| $NH_3$ | — | — |
| $C_1$ | 0.0 | 0.0 |
| $C_2$ | 0.2 | 0.06 |
| $C_2$= | 0.1 | 0.0 |
| $C_3$ | 2.9 | 2.4 |
| $C_3$= | 0.3 | 0.1 |
| Total Dry Gas | 3.6 | 2.6 |
| $iC_4$ | 2.4 | 2.0 |
| $C_4$= | 2.3 | 1.9 |
| $nC_4$ | 3.6 | 3.4 |
| Total $C_4$'s | 8.3 | 7.3 |
| $iC_5$ | 2.0 | 1.9 |
| $C_5$= | 3.0 | 3.0 |
| n-$C_5$ | 3.2 | 3.6 |
| Total $C_5$'s | 8.2 | 8.5 |
| 125–330°F | 21.7 | 19.9 |
| 330–650°F | 6.4 | 6.7 |
| 650+ | 51.8 | 55.0 |
| Total | 100.0 | 100.0 |
| Material Balance | | |
| Recovery, % wt. | 99.6 | 99.6 |

[1]100% Hydrogen - once through.

The properties of lube oil products produced according to this invention are shown below in Table 4 together with the conditions under which they were made. The catalyst was NiZSM-5/$Al_2O_3$.

Table 4

Properties of 650°F+ Lube Oil from Catalytic Hydroprocessing Light Neutral Foots Oil

| Example No. | 4 | 5[1] | 6[2] |
|---|---|---|---|
| Conditions | | | |
| Reactor Temperature, °F | 657 | 668 | 629 |
| Space Velocity, LHSV | 1.3 | 1.5 | 1.5 |
| Hydrogen Circulation, SCF/B[1] | — | 2600 | 2400 |
| Hydrogen Consumption, SCF/B | — | 100 | −125 |
| Yield (as cut) | | | |
| % wt. of charge | — | 51.7 | 54.9 |
| % vol. of charge | — | 50.3 | 53.3 |
| Product Properties | | | |
| API Gravity | 30.9 | 31.2 | 31.7 |
| Specific Gravity, at 60°F | 0.8713 | 0.8697 | 0.8670 |
| Pour Point, °F | 30 | 25 | 35 |
| Flash Point, °F | — | 435 | — |
| KV at 100°F, cs | 33.52 | 33.64 | 32.32 |
| KV at 210°F, cs | 5.39 | 5.41 | 5.33 |
| SUS at 100°F, seconds | 157.3 | 157.9 | 151.9 |
| SUS at 210°F, seconds | 43.6 | 43.7 | 43.4 |
| Viscosity Index | 104 | 104 | 107 |
| Color, ASTM | L- 1.5 | L- 2 | L- 1.5 |
| Aniline Point, °F | 213.8 | 214.0 | 216 |
| Refractive Index at 20°C | 1.47922 | 1.47912 | — |
| Bromine Number | 1.9 | 1.7 | 1.3 |

Table 4-continued

| | | | |
|---|---|---|---|
| Sulfur, % wt. | — | 0.517 | — |
| Nitrogen, % wt. | — | 0.0024 | — |

[1]100% hydrogen — once through.

| Example No. | 5 (D-1160) | 6 (D-1160) |
|---|---|---|
| Distillation, °F | | |
| IBP | 705 | 707 |
| 4 | 742 | 748 |
| 10 | 754 | 769 |
| 30 | 774 | 789 |
| 50 | 802 | 815 |
| 70 | 827 | 837 |
| 90 | 864 | 871 |
| 95 | 877 | 884 |

[1]product from Example 2
[2]product from Example 3

What is claimed is:

1. In the process of producing a lubricant base stock and wax from a distillate fraction boiling in the range of about 650° to 1100°F by the sequnce of processing comprising dearomatizing such distillate by solvent extraction, dewaxing said dearomatized distillate by ketone extraction to produce a first product comprising wax and a second product comprising lubricant base stock, and deoiling said first product to produce a hard wax and Foots oil; the improvement which comprises contacting said Foots oil with a crystalline aluminosilicate zeolite having a silica to alumina ratio of at least about 15, a constraint index of 1 to 12, a crystal density of not substantially below about 1.6 grams per cubic centimeter and a hydrogenation/dehydrogenation component in a proportion of up to about 10 weight percent, said contact being carried out at about 500° to 800°F, about 0.5 to 20 LHSV, under a hydrogen pressure of about 250 to 750 psig, and at a hydrogen circulation rate of about 500 to 2,500 SCFB and resolving the product of such contact into at least a lubricant base stock fraction and a light fraction comprising LPG and naphtha.

2. The process claimed in claim 1 including blending such lubricant base stocks.

* * * * *

UNITED STATES PATENT AND TRADEMARK OFFICE

CERTIFICATE OF CORRECTION

PATENT NO. : 3,960,705

DATED : June 1, 1976

INVENTOR(S) : WILLIAM E. GARWOOD and JOHN J. WISE

It is certified that error appears in the above-identified patent and that said Letters Patent are hereby corrected as shown below:

| | |
|---|---|
| Column 1, line 64 | "fractioned" should be --fractionated--. |
| Column 3, line 57 | "catalyst" should be --catalyze--. |

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*